United States Patent [19]

Wallick

[11] Patent Number: 5,027,712

[45] Date of Patent: Jul. 2, 1991

[54] MONORAIL TRAIN SUSPENDED FROM GUIDEWAY

[76] Inventor: William P. Wallick, 7478 W. 10th Ave., Lakewood, Colo. 80215

[21] Appl. No.: 229,179

[22] Filed: Aug. 5, 1988

[51] Int. Cl.[5] ..... B61B 3/00

[52] U.S. Cl. ..... 104/94; 104/108; 104/DIG. 1; 105/29.2; 105/1.5; 105/4.1; 238/10 E

[58] Field of Search ..... 104/DIG. 1, 93, 94, 104/108; 105/29.1, 29.2, 1.5, 3, 4.1, 150, 153, 155; 191/23 A; 238/10 E, 10 F

[56] References Cited

U.S. PATENT DOCUMENTS

| | | | |
|---|---|---|---|
| 359,662 | 3/1889 | Bierbach | 104/94 |
| 509,650 | 11/1893 | Brodie | 104/108 |
| 719,751 | 2/1903 | Condon . | |
| 1,229,465 | 6/1917 | Hudson | 105/3 |
| 1,396,564 | 11/1921 | Fechner et al. | 104/108 |
| 1,889,112 | 11/1932 | Shoemaker . | |
| 1,974,330 | 9/1934 | Groff . | |
| 2,096,579 | 10/1937 | Frank et al. | 191/23 R |
| 2,106,698 | 2/1938 | Bonanno . | |
| 3,059,588 | 10/1962 | Chadenson | 104/94 |
| 3,115,845 | 12/1963 | Girz . | |
| 3,236,192 | 2/1966 | Esquillan | 104/108 X |
| 3,353,498 | 11/1967 | Davis | 105/3 X |
| 3,540,153 | 11/1970 | Aoki . | |
| 3,922,970 | 12/1975 | Glastra . | |
| 3,922,971 | 12/1975 | Maroshick | 105/3 X |
| 4,217,727 | 8/1980 | Fetty et al. | 238/10 E X |
| 4,781,123 | 11/1988 | Yoshihara | 105/3 X |

FOREIGN PATENT DOCUMENTS

| | | | |
|---|---|---|---|
| 1085553 | 7/1960 | Fed. Rep. of Germany . | |
| 2305018 | 10/1974 | Fed. Rep. of Germany | 104/94 |
| 16226 | of 1900 | United Kingdom | 105/3 |
| 2127310 | 4/1984 | United Kingdom | 238/10 E |

*Primary Examiner*—Margaret A. Focarino
*Assistant Examiner*—Gary C. Hoge
*Attorney, Agent, or Firm*—Gregg I. Anderson

[57] ABSTRACT

A monorail toy train is suspended from an overhead guideway, which guideway is secured to a ceiling or other fixed support structure. The elongated tubular guideway includes a plurality of guideway sections connected together at a joint by a short tubular coupler and a hanger secured to the ceiling. Each guideway section is connected to like length guide rails and rack rails, which, together, define a track for cars of the monorail toy. Trucks of driven and nondriven cars ride on the track defined by the rack rail and guide rail. The driven car includes a drive frame including a motor, drive gear and pinion gear, which pinion gear meshes with the rack rail to provide motive force for the monorail train.

19 Claims, 6 Drawing Sheets

36
37

38
39

22
41
43

22
41
43
38
28
24
26
34
32
40
36
9
8

MONORAIL TRAIN SUSPENDED FROM GUIDEWAY

BACKGROUND OF THE INVENTION

1. Field of the Invention

The present invention relates generally to monorail trains and, more particularly, to model, or toy, trains.

2. Description of the Prior Art

Toy trains have been a staple of children growing up and hobbyists for almost as long as trains themselves have been in existence. Along the same vein, toy monorail trains, the vehicles and their rail system, have been the subject of previous interest, as seen U.S. Pat. No. 3,115,845 issued to A. Girz. No prior art has proposed a suspended monorail toy train particularly designed for suspension from a ceiling or other support structure. The advantages of such an orientation lie principally in the space-saving considerations inherent in such an arrangement as well as the novelty associated with the arrangement. Other advantages of the monorail toy train include the out of the way storage inherent in the train and the dramatic inclusion of height in the train layout.

Hanging or suspended vehicles are shown in the prior art, a truck is disclosed in U.S. Pat. No. 719,751 issued to D. Condon. Condon is not a toy but does show racks which mesh with pinions of the truck to enable the truck to make vertical climbs in a spiral elevator configuration.

U.S. Pat. No. 3,922,970 issued to H. Glastra shows a miniature train system including a track formed from two cylindrical elongated elements defining rails. A power truck of the driving car fits between the rails and the carrying unit of the cars, and envelopes or other goods to be transported hang outward or below the track as the car travels on the track. The car is capable of moving along the track in an inverted position and includes a positive drive means, including pins on the rails and cog wheels on the cars, in order to make vertical travel possible.

U.S. Pat. No. 3,540,153 issued to M. Aoki shows toothed wheels in the mating track which enable a toy vehicle to travel up inclines and in an inverted orientation. Aoki is a toy and does disclose both vertical climbing and inverted travel.

U.S. Pat. No. 1,974,330 issued to E. Groff shows a toy train having coupling means between adjacent cars. U.S. Pat. No. 2,106,698 issued to J. Bonanno shows a wheel with vestibule section coupling adjacent trains.

West German Patent No. 1,085,553 shows the use of flexible intermediate sections to pivot track sections about a pin, forming a switch.

The only toy monorail, and that of a non-suspended type, is noted in the aforesaid patent to A. Girz.

A suspension device for carrying a door or the like is shown in U.S. Pat. No. 1,889,112 issued to R. Shoemaker. Shoemaker shows a wheel truck for relatively easy transition between intersecting track portions.

The prior art does not show or suggest a suspended toy monorail train and consequently, the structural means for accomplishing a suspended monorail toy train are not shown.

Though there is a showing in the prior art, i.e., Condon, of a suspended transportation system, such a suspended transportation system does not show connection of a number of guideway sections to form an electrically-conductive track for receiving a power truck for a drive car of a monorail train.

OBJECTS AND SUMMARY OF THE INVENTION

It is the principal object of the present invention to provide a new and improved monorail toy train having a guideway fixed to a support structure and a plurality of cars suspended from said guideway so that a minimum of usable space in a home is devoted to the monorail toy.

It is a related object of the present invention to provide a new and improved monorail toy train where the guideway has a track incorporated therein for positive engagement with a drive motor of one of the cars.

It is a further related object of the present invention to provide a new and improved monorail toy train where the guideway is easily assembled and disassembled from sections.

It is a still further related object of the present invention to provide a new and improved monorail toy train where a drive truck assembly of a driven car is substantially enclosed within the guideway.

It is still another related object of the present invention to provide a new and improved monorail toy train where the track mounted on the guideway is electrically conductive, and the motor of the driven car receives electric power from the track.

In accordance with the objects of the present invention, a monorail toy train is suspended from a guideway secured to a support structure, such as a ceiling or wall of a room. A number of monorail cars coupled together to make up the monorail toy train. The guideway includes a track mounted thereon, which track engages a transmission connected to a motor mounted within a drive car adapted to pull the remaining cars.

The guideway is constructed of elongated tubular sections that are retained in end to end relation by a plurality of connectors suspended from the support structure. The connectors are identical and are mounted into the ceiling or other support structure to carry the guideway and suspended monorail cars. The track includes a rack rail and a guide rail, both of which include conductive strips to carry electric current. A conductive pin interconnects adjacent rack rails and guide rails from one guideway section to the next.

The drive car includes a drive truck with a drive frame projecting upwardly from the car into the guideway between the rack rail and the guide rail. The motor is mounted to the drive frame and connected by the transmission to a pair of pinion gears which mesh with the rack rail to drive the drive car along the track. Pickup wheels mounted on the drive frame engage the conductive portions of the rack and guide rails to transmit electrical current to the motor.

An idler frame is connected to other nondriven cars, which idler frame projects upwardly into the guideway. Rotatably mounted wheels on the idler frame ride on the rack rail and guide rail to suspend the cars therefrom.

Other aspects, features and details of the present invention can be more completely understood by reference to the following detailed description of the preferred embodiment, taken in conjunction with the drawings, and from the appended claims.

DESCRIPTION OF THE PREFERRED EMBODIMENT

Figure 1:
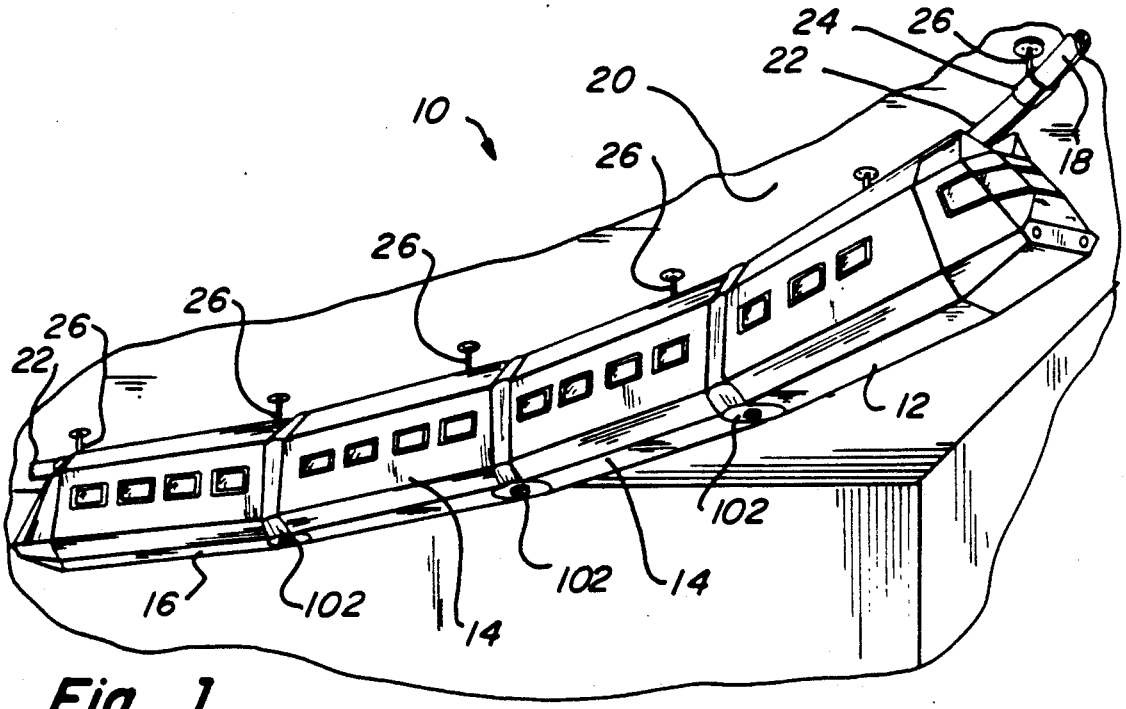
FIG. 1 is a perspective view of a monorail toy train incorporating an overhead guideway with monorail cars suspended therefrom in accordance with the present invention.
Figure 2:
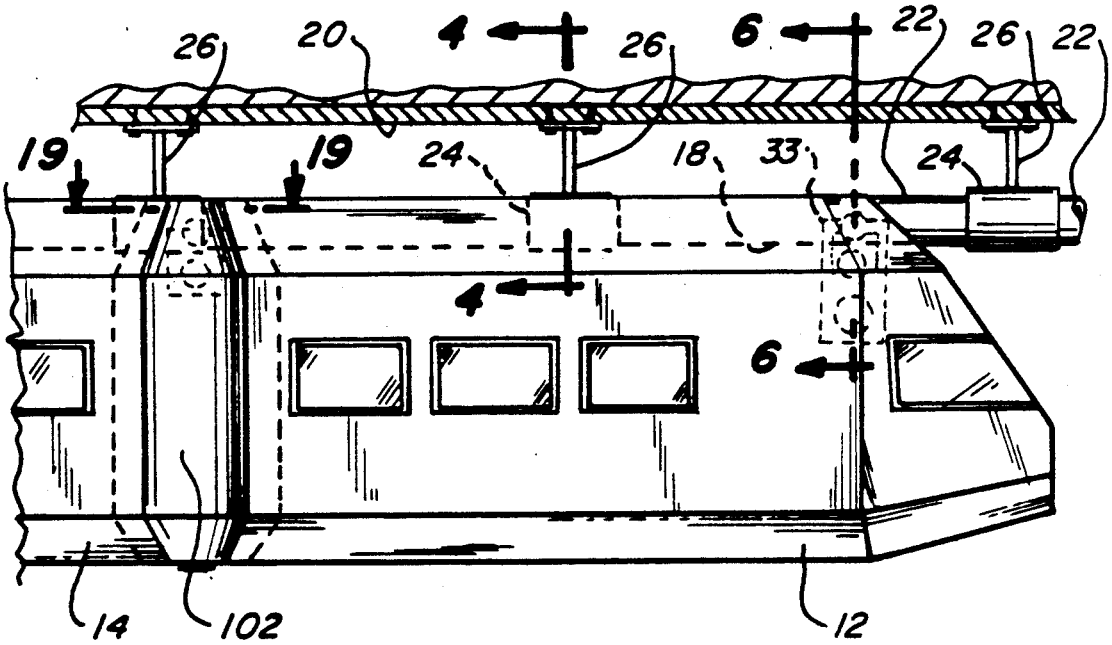
FIG. 2 is an enlarged side elevational view of the invention shown in FIG. 1, a ceiling support structure shown in section, and means for hanging the cars from the guideway being shown in phantom line.
Figure 3:
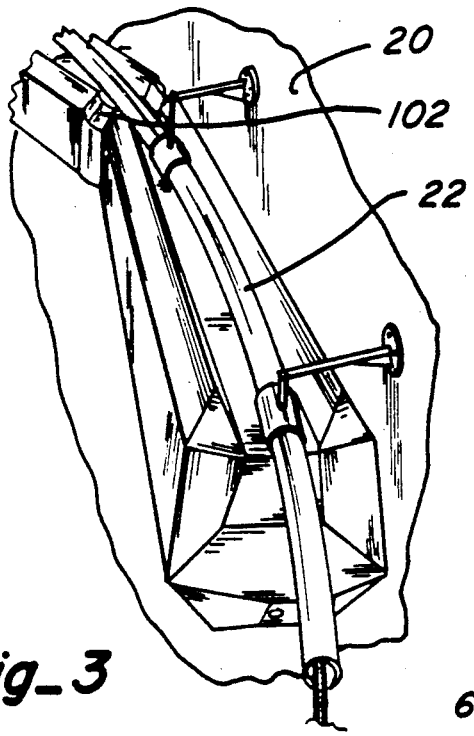
FIG. 3 is a fragmentary perspective view of the invention shown in FIG. 1, showing an alternative wall support structure.

A suspended monorail toy train 10 is seen in FIG. 1 to include an overhead guideway 18 having suspended therefrom a lead drive car 12 coupled to nondriven cars 14, including a trailing car 16. The guideway 18 is fixedly connected to the underside of a ceiling or wall fixed support structure 20. (FIGS. 2 and 3).

Figures 7, 8, 9, 10:
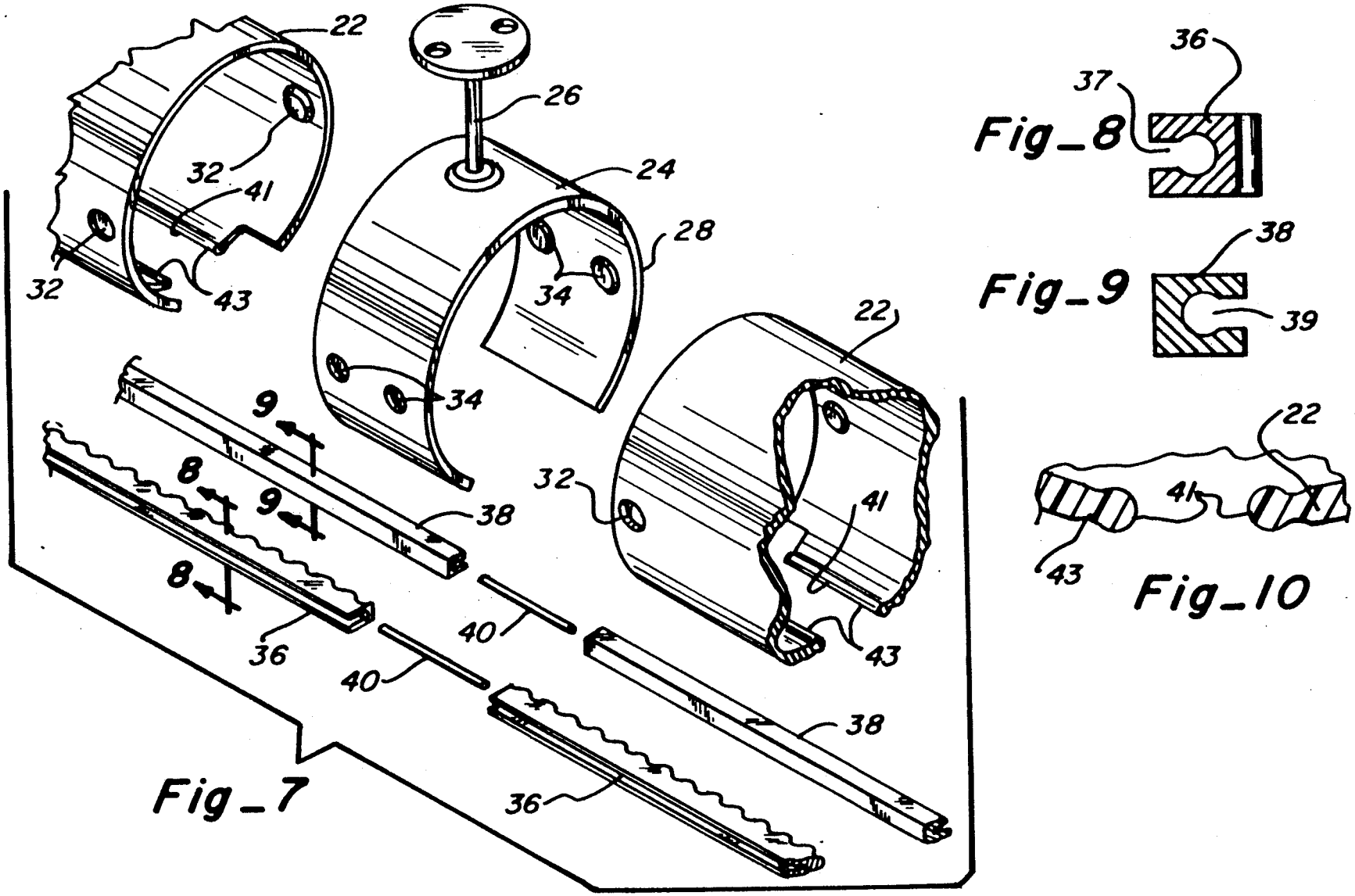
FIG. 7 is an enlarged, fragmentary, exploded perspective view of two guideway sections, a coupler therefor, and track mounted thereto of the invention shown in FIG. 1.
FIG. 8 is a sectional view of a rack rail taken along line 8—8 of FIG. 7.
FIG. 9 is a sectional view of a guide rail taken along line 9—9 of FIG. 7.
FIG. 10 is an enlarged fragmentary sectional view of a guideway section of the invention shown in FIG. 1.
Figure 14:
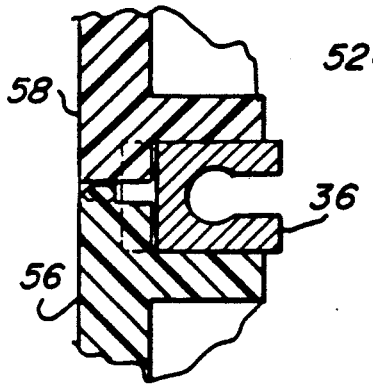
FIG. 14 is an enlarged, fragmentary sectional view taken along line 14—14 of FIG. 11.

The guideway 18 includes a plurality of elongated, tubular guideway sections 22 selectively and releasably secured to each other by guideway connectors 24. The connectors 24 include a coupler 28 and an integral hanger 26. (FIG. 7). The coupler 28 is used to receive and retain guideway sections 22 while the hanger 26 is secured to the ceiling 20. The guideway connector 24 therefore connects adjacent pairs of the guideway sections 22 and supports the entire guideway 18 from the ceiling or other fixed support structure 20.

The guideway sections 22 define, at a bottom thereof, a track 35 (FIGS. 4 and 5) along which track 35 a drive truck 33 (FIGS. 12 and 13) rides. A drive frame 42 of the truck 33 is fixedly connected by conventional means to the lead drive car 12 and projects from the drive car 12 between a conductive rack rail 36 and a conductive guide rail 38 of the track 35, defining means for suspending cars from the guideway 18. The conductive rack rail 36 and the conductive guide rail 38 extend parallel to each other along the guideway sections 22, to which guideway sections 22 the rails 36 and 38 are mounted. A transmission 45 mounted to the drive frame 42 transmits rotary power from a drive motor 46 to the rack rail 36 to move the drive car 12 along the track 35, pulling the nondriven cars 14 and 16.

Figure 4:
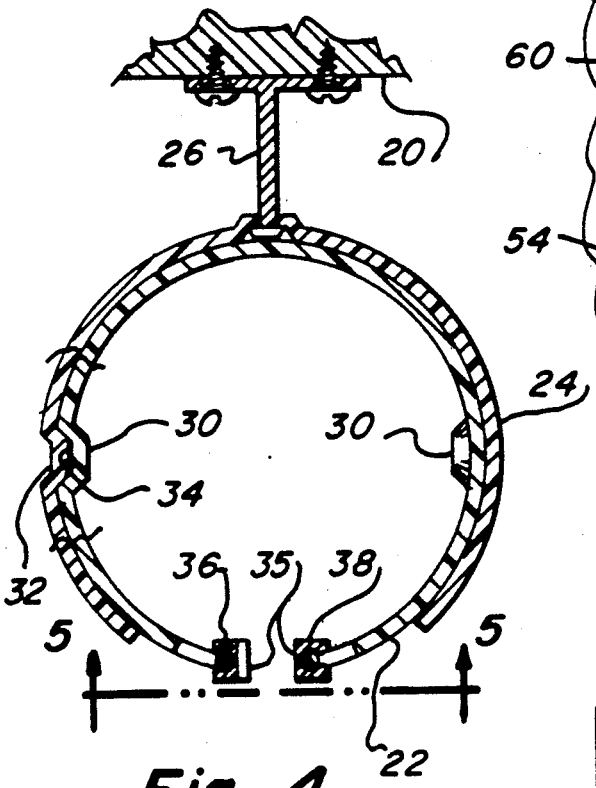
FIG. 4 is a sectional view taken along line 4—4 of FIG. 2.
Figure 5:
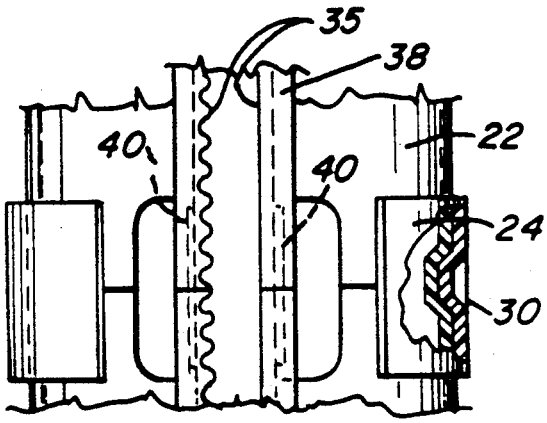
FIG. 5 is a fragmentary bottom plan view taken along line 5—5 of FIG. 4.

The coupler 28 and guideway sections 22 are interconnected by a detent snap connection 30. (FIGS. 4 and 5). The coupler 28 includes opposed pairs of projections 34 formed on an inner surface thereof. The inner surface of the coupler 28 receives an outer surface of the guideway sections 22, defining a frictional fit between the coupler 28 and guideway section 22. The projections 32 formed on the inner surface of each of the couplers 28 fit into detents 34 on the outer surface of the guideway sections 22 to secure the coupler 28 to a pair of guideway sections 22. Each coupler 28 is, therefore, seen to establish a joint between two guideway sections 22.

The rack rail 36 and the guide rail 38 each have cavities 37 and 39, respectively (FIGS. 8 and 9), formed along an outer surface thereof. The cavities 37 and 39 receive an elongated bulb portion 41 (FIG. 10) formed along parallel terminal edges 43 of the guideway sections 22. The bulb portion 41 is matingly received in the cavities 37 and 39. (FIG. 4). The rack rail 36 and guide rail 38 are joined to the guideway sections 22. A conductive pin track connector 40 fits into the cavities 37 and 39 at the joint defined by the coupler 28 to provide a conductive pathway between adjacent rack rails 36 and guide rails 38. (FIGS. 5 and 7). The rack rail 36 and guide rail 38 each include on upper and lower surfaces thereof a conductive metal strip permanently connected thereto to carry electric current supplied from a transformer and AC power supply. (not shown).

Figure 6:
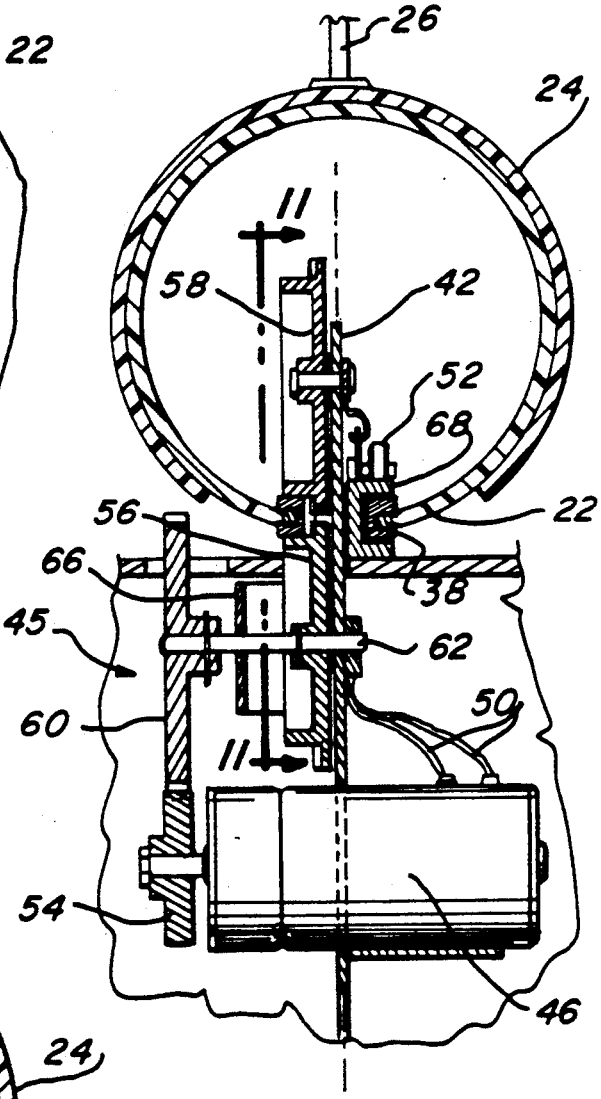
FIG. 6 is a fragmentary sectional view taken along line 6—6 of FIG. 2.
Figure 12:
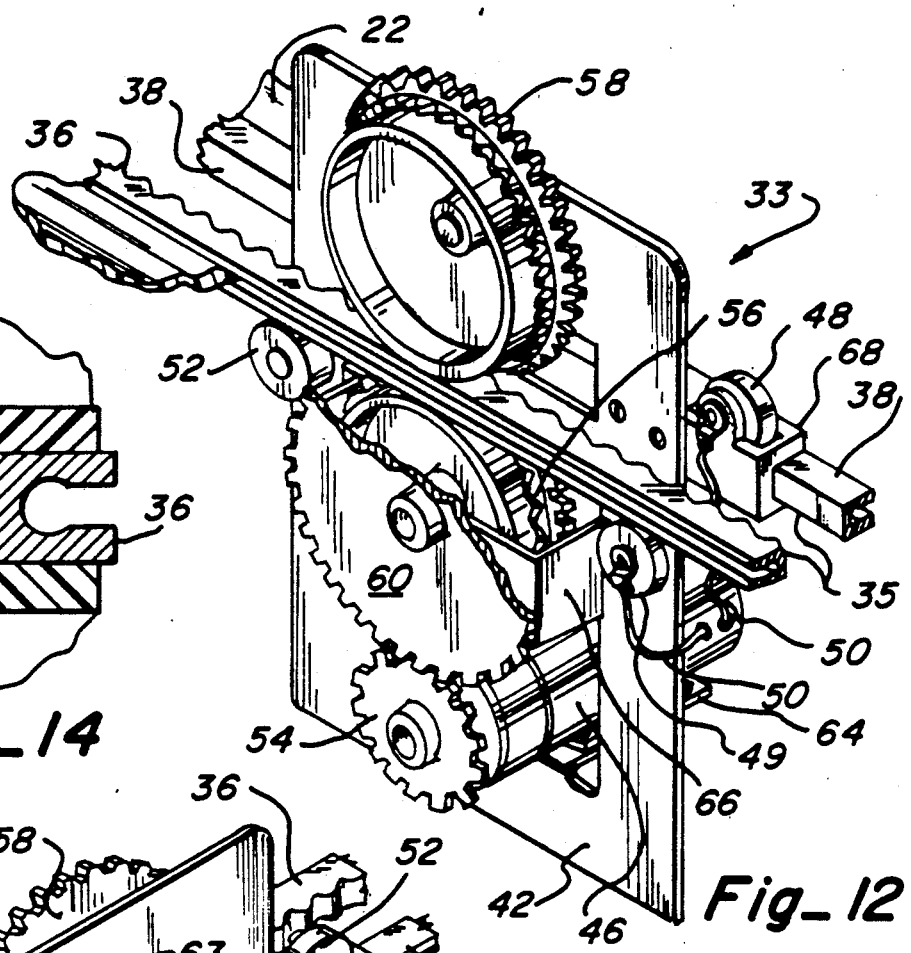
FIG. 12 is a perspective view of a drive truck of a driven car engaged with the track of the invention shown in FIG. 1.
Figure 13:
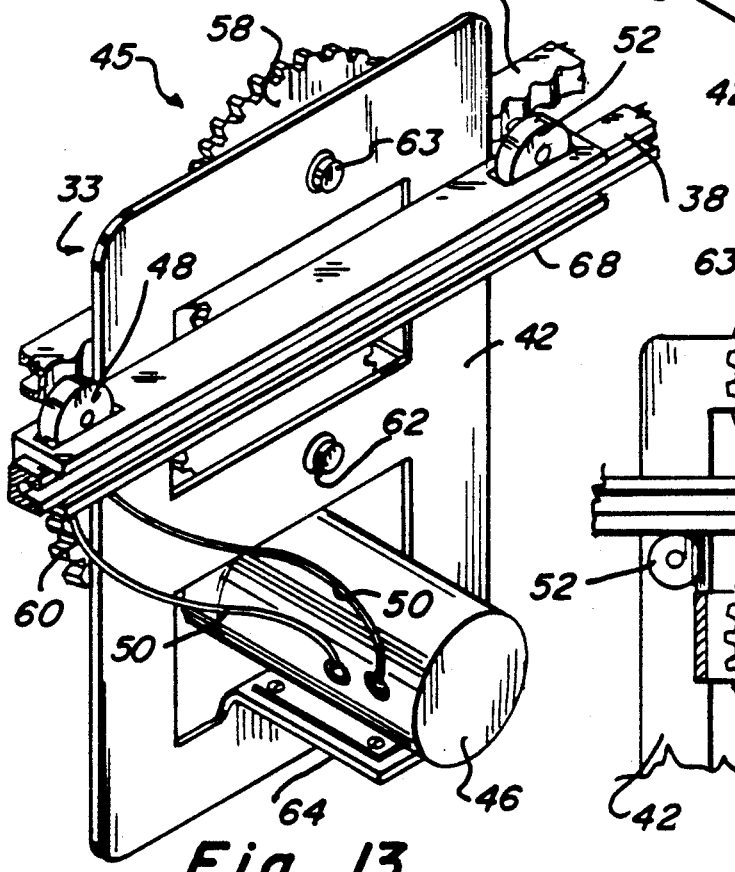
FIG. 13 is a perspective from the side opposite the view of FIG. 12 of the invention shown in FIG. 1.

As best seen in FIG. 6, the drive frame 42 carries the drive motor 46 and transmission 45. A guide sleeve 68 is attached to one side of the drive frame 42. The guide sleeve 68 slidingly engages the guide rail 38 to support one side of the drive frame 42 and connected drive car 12. (FIGS. 12 and 13). An upper pickup wheel 48 is rotatably connected to the guide sleeve 68 to receive current from the guide track 38, which current passes along conductor 50 to the motor 46. An idler wheel 52 is rotatably connected to an end of the guide sleeve 68 opposite from the end to which the pickup wheel 48 is connected.

The transmission 45 is connected to the other side of the drive frame 42, as is a second pickup wheel 49, which engages a bottom surface of the rack rail 36, picking up current from the rack rail 36 and transmitting it along conductor 50 to the motor 46. In a like manner, as was discussed with respect to the guide sleeve 68, a second idler wheel 53 is rotatably connected to the drive frame 42 at the opposite end of the drive frame 42 to contact the bottom surface of the rack rail 36.

Figure 11:
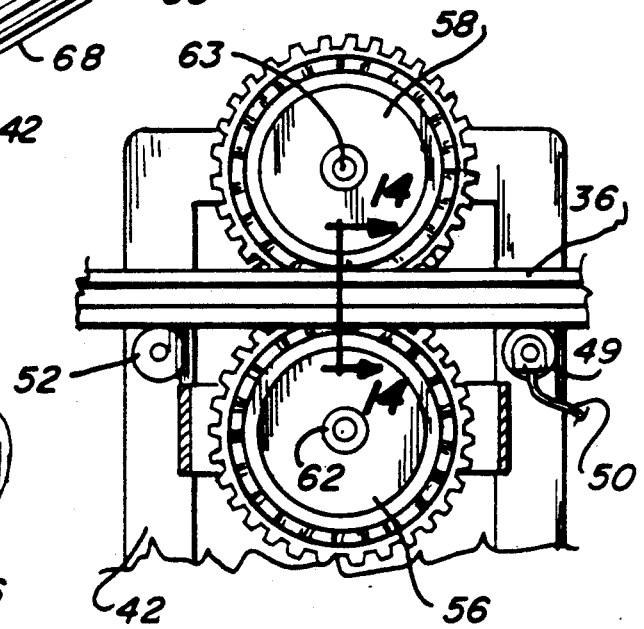
FIG. 11 is a fragmentary side elevational view of a pair of pinion gears of a transmission meshed with the rack rail of the invention shown in FIG. 1.

The transmission 45 includes a drive gear 54 fixedly connected to an output shaft of the drive motor 46. The drive gear 54 meshes with an idler gear 60, which is coaxially mounted on axle 62 with a lower pinion gear 56. The lower pinion gear 56 meshes with the rack rail 36 to provide a positive drive for the lead drive car 12. (FIG. 11).

An upper meshing gear 58 is rotatably connected to the drive frame 42 by axle 63 and contacts an upper surface of the rack rail 36, meshing with the lower pinion gear 56 and the rack rail 36 to stabilize the drive frame 42 and, therefore, the drive car 12 on the track 35. A bracket 66 supports the axle 62 for the idler gear 60 and lower pinion gear 56, which bracket extends away from and defines a parallel plane with the drive frame 42. (FIG. 12).

A mounting flange 64 supports the drive motor 46. The upper meshing gear 58 is rotatably mounted by the axle 63 to the drive frame 42, while the axle 62 rotatably mounts the idler gear 60 and the lower pinion gear 56 to the drive frame 42, establishing a coaxial relationship therebetween.

Figure 15:
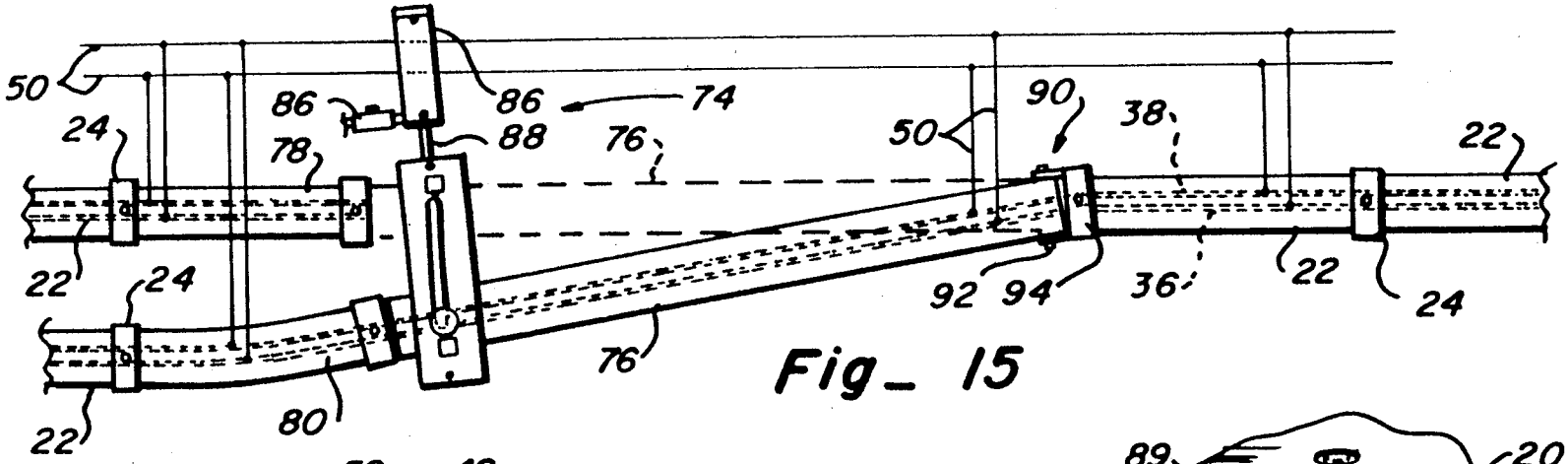
FIG. 15 is a top plan view of a switch for a guideway section of the invention shown in FIG. 1.
Figure 16:
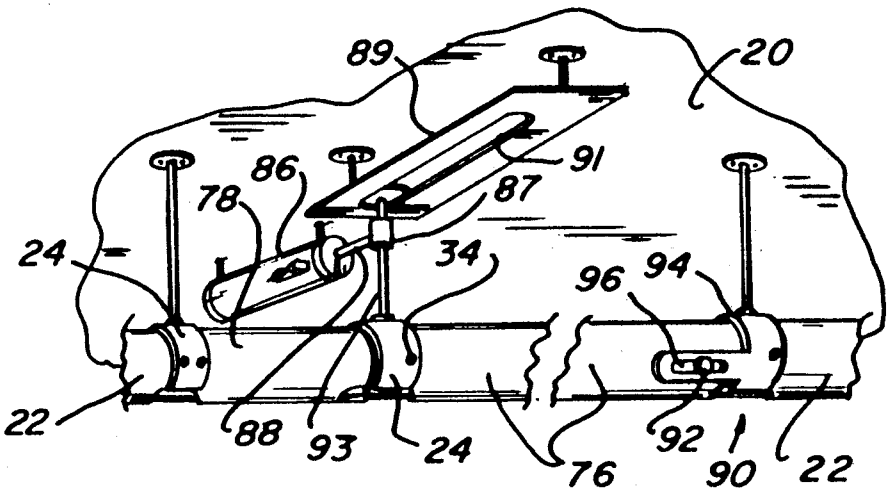
FIG. 16 is a fragmentary perspective view of the switch for the guideway sections of FIG. 15.
Figure 17:
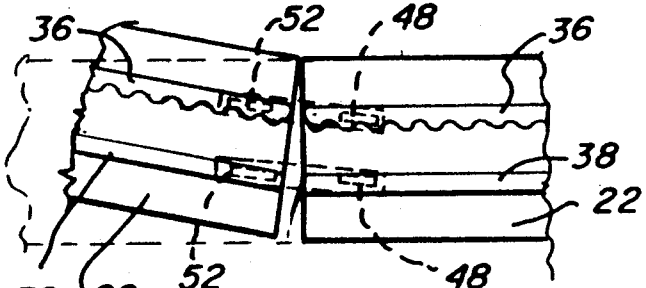
FIG. 17 is an enlarged fragmentary plan view of a pivotal guideway section used in conjunction with the switch of FIG. 15.

A switch 74 (FIGS. 15–18) is used to direct the monorail train 10 from the guideway section 22 of FIG. 15 along pivotal section 76 to either right section 78 or left section 80. An electric switch 82 is electrically connected by conductors to the conductive portions of the rack rail 36 and the guide rail 38 of the sections 22,76,78 and 80. Remote actuator 86 is energized by the switch 82, which actuator 86 is pivotally connected by arm 88 to the section 76 by joint 87. The switch 82 toggles to move the section 76 between alignment with the right and left sections 78 and 80. A slide 89 mounted in the ceiling 20 has a slot 91 which receives a movable hangar 93 fixedly connected to the pivotal section 76. The switch 82 moves the arm 88 connected to the hangar 93 along slot 91, moving the track 35 of the pivotal section 76 between sections 78 and 80, changing the path of the monorail train 10.

Figure 18:
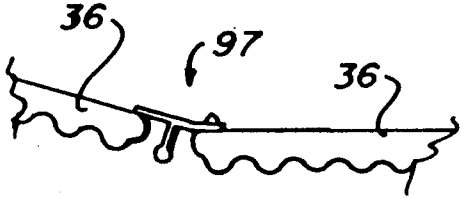
FIG. 18 is an enlarged fragmentary plan view of the connection between adjacent rack rails used in conjunction with the switch of FIG. 15.

Joint 90 (FIGS. 15 and 16) allows section 76 to pivot with respect to section 22. A pin connection 92 of section 76 pivotally connects to an end cap 94 of the guideway section 22. A slot 96 of the end cap 94 allows the pin 92 and section 76 to pivot in the plane of the guideway 18. Adjacent sections of the track 35 are sufficiently aligned at the joint 90 and at the connections between the sections 76 and 78 and the connection between sections 76 and 80 to allow the truck 33 to engage the rack rail 36 as the section 76 is traversed by the monorail train 10. Tooth 97 is inserted between rack rails 36 to take up any misalignment. (FIG. 18).

Section 76 has electrical current supplied to it independent of sections 22, 78 and 80 so that the pin connector 40 is not necessary to supply electrical current to the section 76.

The cars 14 are suspended and coupled as seen in FIGS. 17 through 22. Upwardly projecting fairings 100 of triangular cross-section (FIG. 22) obscure the viewer's view of the guideway 18.

Figure 19:
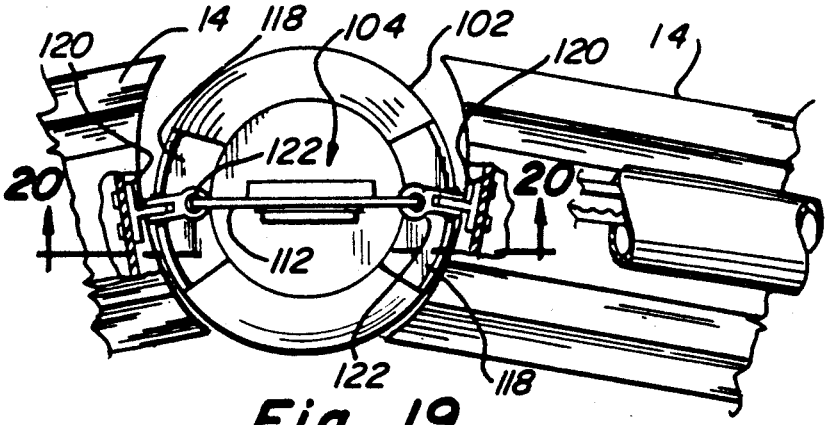
FIG. 19 is a top plan view taken along line 19—19 of FIG. 2.
Figure 20:
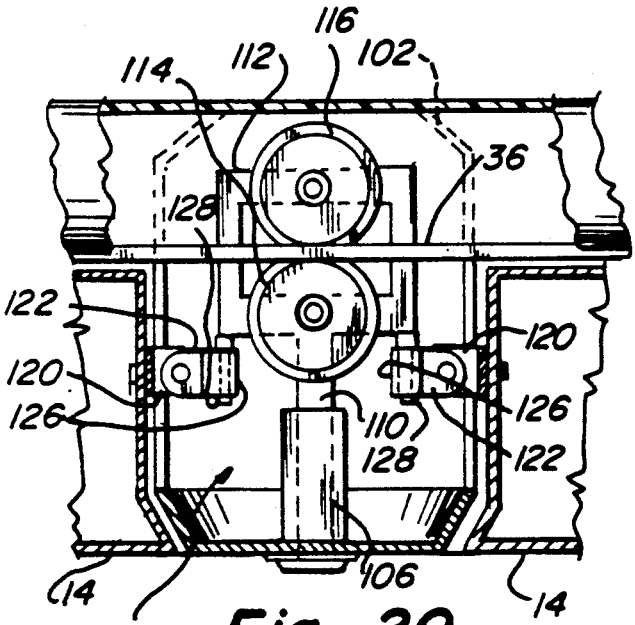
FIG. 20 is a sectional view taken in along line 20—20 of FIG. 19.
Figure 21:
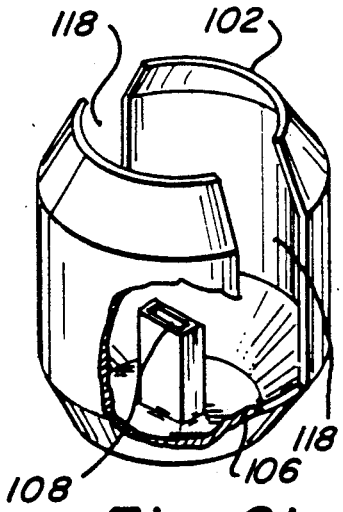
FIG. 21 is a fragmentary perspective view of a housing for a truck shown in FIG. 19.
Figure 22:
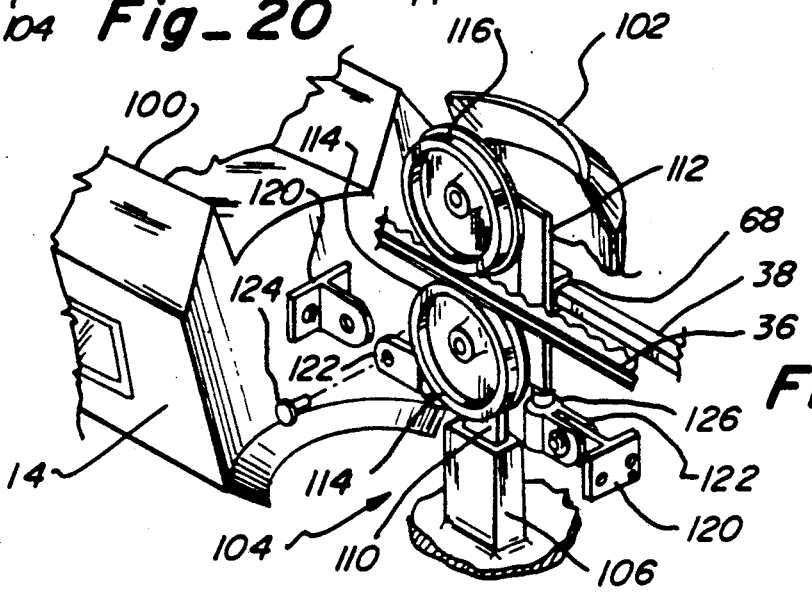
FIG. 22 is a fragmentary perspective view similar to FIG. 21 with the truck of FIG. 19.

A coupling housing 102 interconnects the cars 14. A nondriven truck 104 is mounted interiorly of the housing 102 in a slide stand 106 projecting upwardly from a bottom surface of the housing 102 to a predetermined height. A slot 108 in the stand 106 receives a tang 110 integrally formed with an idler frame 112, which together with the drive frame 42 defines means for suspending cars from the guideway 18. The frame 112 has the sleeve 68 mounted to one side thereof for sliding engagement with the guide rail 38. The other side of the frame 112 has rotatably mounted thereto a lower idler wheel 114 and an upper idler wheel 116, which engage the rack rail 36 therebetween. (FIG. 20). The housing 102 includes a pair of openings 118, which allow for a connection to the car 14. (FIGS. 19 and 21). Each of the cars 14 includes a T-shaped connector 120 fixedly connected thereto and having a hole therethrough. A yoke 122 on either side of the frame 112 has arms which position the T-connector 120 therebetween so that a pivotal connection can be established by a rivet 124. The yoke 122 includes a cylindrical sleeve portion 126 which receives depending pins 128 fixedly connected to the frame 112. A pivotal connection having two axes of pivotal movement is provided by the yoke 122 connection to the cars 14.

Although the present invention has been described with a certain degree of particularity, it is understood that the present disclosure has been made by way of example, and changes in detail or structure may be made without departing from the spirit of the invention, as defined in the appended claims.

I claim:

1. A monorail train including a plurality of cars coupled together, at least one of which cars has an electric motor and is driven, comprising in combination:

a guideway from which said cars are suspended, said guideway including plural, elongated tubular sections selectively joined together by relatively short tubular connectors, each of said connectors having an inner surface which receives an outer surface of a pair of adjacent tubular sections, said connectors being connected to a fixed support structure, said sections having incorporated therein a track carrying electric current, a motor in said driven car, means operatively connecting said motor to said track for conducting electric current from said track to said motor, said track including a rack rail and a guide rail mounted along terminal edges of said sections, a drive gear rotated by said motor, a pinion gear rotatably connected to a drive frame and meshing with said rack rail, said drive frame fixedly connected to said drive car and projecting between said rack rail and guide rail into said guideway with said pinion gear meshing with said drive gear to propel said monorail train along said track in a suspended position beneath said guideway when electric current is conducted to said motor.

2. The invention as defined in claim 1 wherein said connectors define a joint for at least two sections, said connector having a hanger for securing to said support structure and a coupler for connecting to said guide sections, said guide sections matingly fitting into said coupler portion.

3. The invention as defined in claim 2 wherein said sections are connected to said connector by a snap connection.

4. The invention as defined in claim 1 wherein said rack rail and guide rail include means for carrying current between adjacent rack rail and guide rail portions.

5. The invention as defined in claim 1 wherein said drive frame further includes a guide sleeve mounted thereon for slidingly engaging said guide rail.

6. The invention as defined in claim 1 wherein said drive frame includes means for stabilizing the drive frame with respect to the guide rail and rack rail.

7. The invention as defined in claim 6 wherein said means for stabilizing further includes forward and rearward idler wheels rotatably connected to said drive frame, which rotatably engage upper and lower surfaces of both of said rack rail and guide rail.

8. The invention as defined in claim 7 wherein said pinion gear engages a bottom surface of said rack rail and a like mesh gear rotatably connected to said drive frame meshes with said pinion gear and contacts an upper surface of said rack rail.

9. The invention as defined in claim 1 wherein one of said sections is pivotally connected to another of said sections for selective movement by switching means between a left and a right section.

10. The invention as defined in claim 1 wherein selected ones of said cars include means for suspending cars from said guideway and which further includes means mounted thereon for riding on said rack rail and guide rail.

11. The invention as defined in claim 10 wherein said means for suspending cars is mounted in a housing and is pivotally connected to adjacent cars for pivotal movement about two axes.

12. A monorail train including a plurality of cars coupled together, at least one of which cars has an electric motor and is driven, comprising in combination:

a guideway from which said cars are suspended, said guideway including plural elongated tubular sections selectively joined together by connectors connected to a fixed support structure, said sections having mounted thereon a track carrying electric current, said track including a rack rail and a guide rail;

a drive car of said train including a motor and a drive gear, said motor receiving current from said track, said drive gear mounted on a drive frame with said motor for rotating a pinion gear rotatably connected to said drive frame and meshed with said rack rail of said track, said drive frame fixedly connected to said drive car and projecting between said rack rail and said guide rail into said guideway, whereby said motor in said drive car propels said monorail train along said track at a suspended position beneath said guideway.

13. The invention as defined in claim 12 wherein said drive frame further includes a guide sleeve mounted thereon for slidingly engaging said guide rail.

14. The invention as defined in claim 1 wherein said drive frame includes means for stabilizing the drive frame with respect to the guide rail and rack rail.

15. The invention as defined in claim 6 wherein said means for stabilizing further includes forward and rearward idler wheels rotatably connected to said drive frame, which rotatably engage upper and lower surfaces of both of said rack rail and guide rail.

16. The invention as defined in claim 7 wherein said pinion gear engages a bottom surface of said rack rail and a like mesh gear rotatably connected to said drive frame meshes with said pinion gear and contacts an upper surface of said rack rail.

17. A monorail train including a plurality of cars coupled together, at least one of which cars has an electric motor and is driven, comprising in combination:

a guideway from which said cars are suspended, said guideway including plural elongated tubular sections selectively joined together by connectors connected to a fixed support structure, said sections having mounted thereon a track carrying electric current, said track including a rack rail and a guide rail;

a drive car of said train including a motor and a drive gear, said motor receiving current from said track, said drive gear mounted on a drive frame with said motor for rotating a pinion gear rotatably connected to said drive frame and meshed with said rack rail of said track, said drive frame fixedly connected to said drive car and projecting between said rack rail and said guide rail into said guideway, said pinion gear engaging a bottom surface of said rack rail and a like mesh gear rotatably connected to said drive frame meshing with said pinion gear and contacting an upper surface of said rack rail whereby said motor in said drive car propels said monorail train along said track at a suspended position beneath said guideway.

18. A monorail train including a plurality of cars coupled together, at least one of which cars has an electric motor and is driven, comprising in combination:

a tubular guideway having a track defined by a rack rail and a guide rail, said guideway suspended from a support structure, a drive frame of at least one of said cars having mounted thereto an electric motor and transmission operatively connecting to said rack rail, said drive frame including a guide sleeve mounted on one side thereof for sliding engagement with said guide rail and idler wheels rotatably mounted thereto for establishing rolling contact with opposite sides of said guide rail and rack rail, at least two pick up wheels rotatably mounted to said drive frame for contacting conductive portions of said rack rail and said guide rail, which pick up rails are conductively connected to said motor.

19. A monorail train including a plurality of cars coupled together, at least one of said cars having an electric motor mounted therein, comprising in combination:

a guideway from which said cars are suspended, said guideway including a plurality of elongated tubular sections selectively joined together by relatively short tubular connectors, each of said connectors having an inner surface adapted to receive an outer surface of a pair of adjacent tubular sections, said connectors being connected to a fixed support structure, said sections having incorporated therein a track carrying electric current, means operatively engaging said track and operatively connected to said motor for conducting electric current from said track to said motor, said track including a rack rail and a guide rail mounted along terminal edges of said sections, a drive gear rotated by said motor and operatively engaging said rack rail to propel said train along said track in a suspended position beneath said guideway when said motor receives current from said track, a drive frame for suspending cars from the guideway, said drive frame including a guide sleeve mounted on one side thereof for sliding engagement with one of said rack rail or said guide rail and idler wheels rotatably mounted to said drive frame for establishing rolling contact with top and bottom surfaces of the other of said rack rail or said guide rail, and said electric current conducting means including at least two pick-up wheels rotatably mounted to said drive frame for connecting conductive portions of said rack rail and guide rail and means connectively coupling said pick-up to said motor.

* * * * *